United States Patent [19]

Sigmund et al.

[11] Patent Number: 4,592,376

[45] Date of Patent: Jun. 3, 1986

[54] HAIR DYE APPLICATING APPARATUS

[75] Inventors: Ludwig Sigmund, Pfungstadt; Franz Steigerwald, Griesheim; Karlheinz Zulauf, Höchst-Hassenroth, all of Fed. Rep. of Germany

[73] Assignee: Wella Aktiengesellschaft, Darmstadt, Fed. Rep. of Germany

[21] Appl. No.: 250,704

[22] Filed: Apr. 3, 1981

[30] Foreign Application Priority Data

Apr. 10, 1980 [DE] Fed. Rep. of Germany ..... 3013769

[51] Int. Cl.[4] ..... A45D 24/22

[52] U.S. Cl. ..... 132/112

[58] Field of Search ..... 132/112, 120, 124, 88.5, 132/88.7, 85, 11 R, 84 R; 119/95; 401/190; 222/397, 191, 195; 220/293, 345, 346

[56] References Cited

U.S. PATENT DOCUMENTS

| | | | |
|---|---|---|---|
| 2,171,591 | 9/1939 | Minich | 132/84 R |
| 2,243,774 | 5/1941 | Resh | 132/84 R |
| 2,299,296 | 10/1942 | Battle | 132/112 X |
| 2,591,831 | 4/1952 | Knuff | 401/83 |
| 2,793,792 | 5/1957 | Pilkington | 222/191 |
| 2,819,723 | 1/1958 | Meyer | 132/120 X |
| 3,119,142 | 1/1964 | Fletcher | 132/112 |
| 3,741,310 | 6/1973 | Hansen | 220/293 |
| 3,768,691 | 10/1973 | Cobb | 220/293 |
| 3,973,528 | 8/1976 | Walter | 132/11 R |
| 4,044,724 | 8/1977 | Merchill | 132/112 |
| 4,294,270 | 10/1981 | Cochran | 132/112 |
| 4,331,266 | 5/1982 | Bond | 220/345 |

*Primary Examiner*—Gregory E. McNeill

*Attorney, Agent, or Firm*—Michael J. Striker

[57] ABSTRACT

A hair dye applicating apparatus has a handle part formed as a hair dye supply container, a combination part connected with the supply container, a hair separating tip arranged on the combination part in spaced relationship with the supply container, a comb member having a plurality of tines and arranged on the combination part adjacent the supply container, a hair dye application part including a displaceable brush member having a plurality of bristle bundles, and an elastic nozzle member located inside the brush member so as to be surrounded by the bristle bundles and to form a hair dye outlet opening.

15 Claims, 12 Drawing Figures

1
2
3
14
8
9
13
15a
15
15b
γ
10
β
4
α
6
11
10a
7
5

11
10a
4
8
9
5

9
8
15b
15
10
10a
15a
α
β
γ
5
11
4
7
6
13
47
45
39
40
14
36
37
46
3
16
4a
21
17
20
19
1
2

HAIR DYE APPLICATING APPARATUS

BACKGROUND OF THE INVENTION

The present invention relates to a hair dye applicating apparatus.

Hair dye applicating apparatuses are known in the art such as for example the apparatus disclosed in the German Offenlegungsschrift No. 2,749,074 and the corresponding British published specification No. 2,008,402. A hair dye applicating apparatus as disclosed in these references has an application part having a piston provided with a prestressed spring and supplying a hair dye via a pressure-reducing valve, and a hollow comb tines associated with the laterally arranged brush. The known hair dye applicating apparatuses possess some disadvantages in the sense of their construction and operation.

SUMMARY OF THE INVENTION

Accordingly, it is an object of the present invention to provide a hair dye applicating apparatus, particularly for cream-like hair dyes, which has a simple construction and thereby facilitates filling of a supply container of the apparatus as well as application of the hair dye.

In keeping with this object, and others which will become apparent hereinafter, one feature of the present invention resides, briefly stated, in a hair dye applicating apparatus which has a handle part formed as a hair dye supply container, a combination part connected with the supply container, a hair separating tip arranged on the combination part in spaced relationship to the supply container, a comb member having a plurality of tines and arranged on the combination part adjacent to the supply container, a hair dye application part formed as a displaceable brush member having a plurality of bristle bundles and a hair dye outlet opening, and an elastic nozzle member located inside the brush member so as to be surrounded by the bristle bundles and to form the outlet opening.

When a hair dye applicating apparatus is designed in accordance with the present invention, it has a simple construction and provides for easy filling of the supply container and application of hair dye. It is especially suitable for cream-like hair dyes.

In accordance with another advantageous feature of the present invention, the supply container has a substantially cylindrical transparent and rigid wall and is provided with a piston which reciprocates in the interior of the container with the aid of transporting means.

In accordance with a further advantageous feature of the present invention, the piston has a piston rod provided with a plurality of teeth and turnable over approximately an angle of at least 45°, preferably of 90°, between a transporting position in which the transporting means engage with the teeth of the piston rod and can displace the piston toward the application part, and a filling position in which the transporting means is engaged from the teeth of the piston rod and the piston rod together with the piston can axially freely reciprocate.

The novel features which are considered characteristic for the present invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figures 1, 1A:
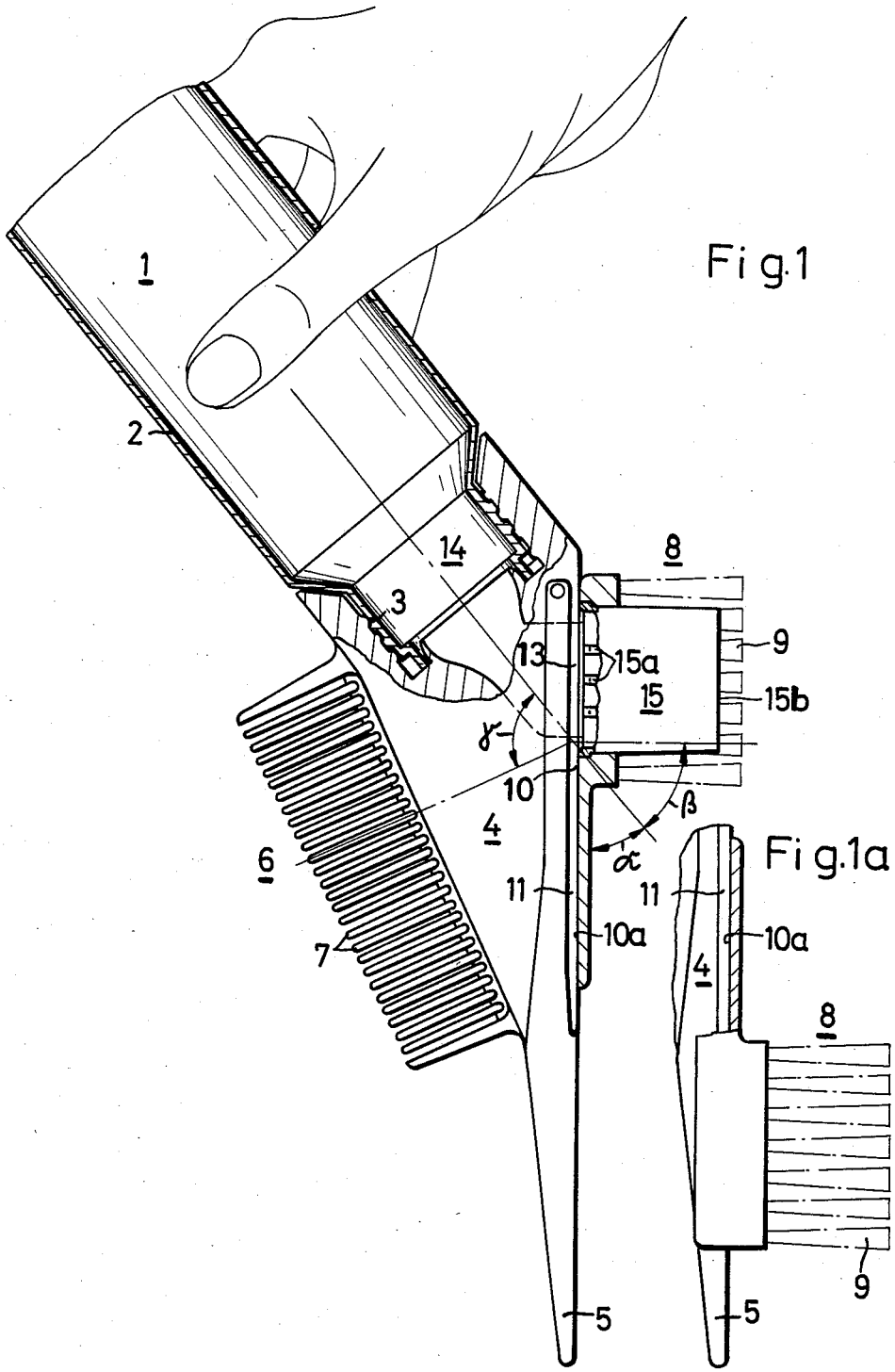
FIG. 1 is a view showing a hair dye applicating apparatus in accordance with the present invention, wherein the apparatus is partially sectioned, a container of the apparatus is shown not completely, and a brush member of the apparatus is shown in applicating position.
FIG. 1*a* is a side view of a fragment of FIG. 1, showing the brush member in mixing position with closed outlet opening.
Figures 2, 3:
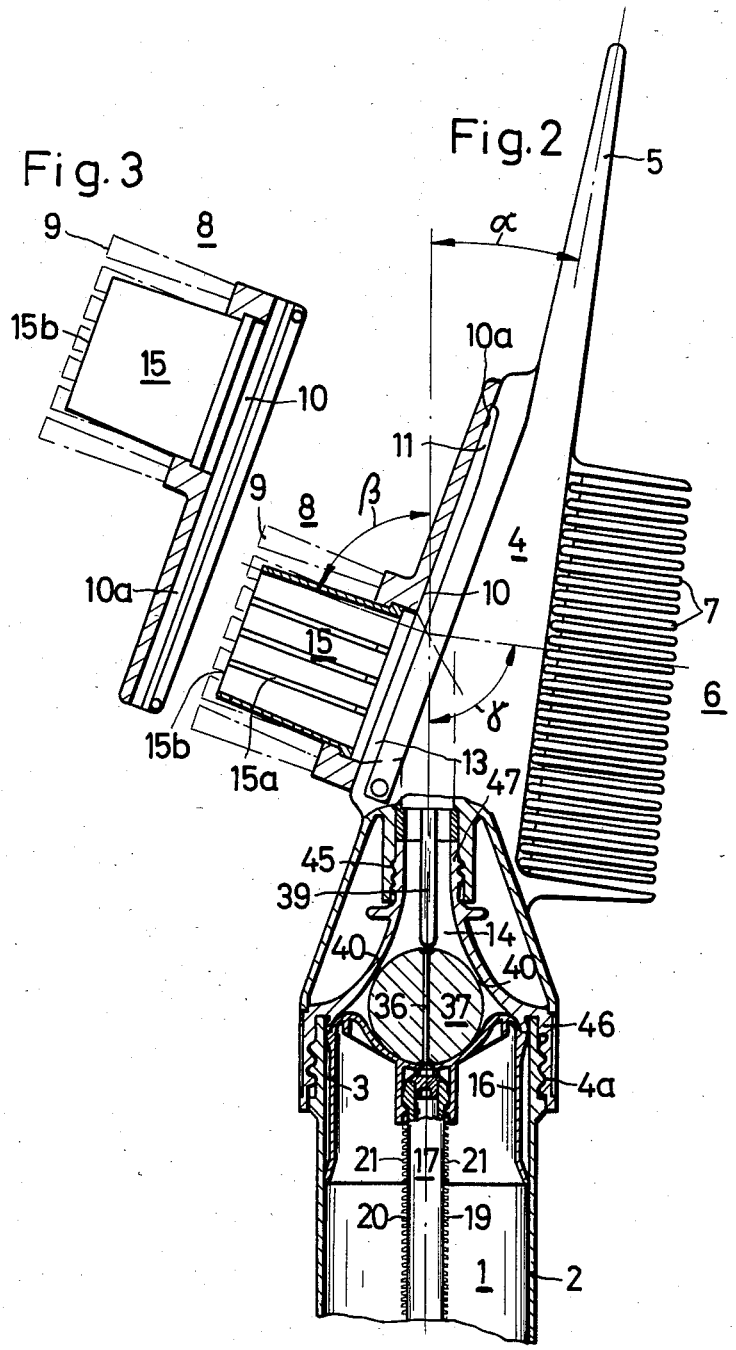
FIG. 2 is a view showing a hair dye applicating apparatus in accordance with a second embodiment of the present invention, wherein the container is not shown completely and the brush member is shown in applicating position.
FIG. 3 is a view showing the brush member of the apparatus of FIG. 2, in a mixing position.

A hair dye applicating apparatus shown in FIG. 1 has a supply container 1 which is formed as a handle and has an elastic creasable and transparent wall 2. A supply container 1 has a portion forming an opening 3, and a combination part 4 is screwed on this portion.

A hair separating projection or tip 5, a comb member 6 with tines 7, and an application part including a brush member 8 are mounted on the combination part 4. The separating tip 5 has a longitudinal axis which includes an angle $\alpha$ of approximately 40° with the longitudinal axis of the supply container 1. The longitudinal axes of the tines 7 of the comb member 6 include an angle $\gamma$ of at least approximately 60°, preferably of 75°, with the longitudinal axis of the supply container 1. The longitudinal axes of bristle bundles 9 of the brush member 8 include an angle $\beta$ of at least 40°, preferably of 50°, with the longitudinal axis of the supply container 1.

The brush member 8 is provided at its side facing toward the combination part 4, with a dovetailed groove 10. The combination part 4 has a dovetailed projection 11 displaceably engageable in the dovetailed groove 10 of the brush member 8. The dovetail shaped projection 11 has, at its end facing toward the supply container 1, a slot-shaped throughgoing opening 13 which communicates with an interior space 14 of the combination part 4 with the interior of the supply container 1. The brush member 8 has a part located over the throughgoing opening 13 and carrying an elastic slot-shaped nozzle insert 15. When the brush member 8 is removed from the dove-shaped opening 13, the nozzle insert 15 can be inserted through a respective opening of the brush member 8. The slot-shaped nozzle insert 15 may be constituted of rubber. It is embraced at both its longitudinal sides by the bristle bundles 9, and the latter extend outwardly beyond the transverse dimension of the nozzle insert 15 so as to overlap its outlet opening 15*b*.

The above-described hair dye applicating apparatus operates in the following manner:

The combination part 4 is unscrewed from the supply container 1, and the latter is filled through its opening 3 by components of a hair dye, for example hydrogen peroxide and special hair dyes. The applied amount of the components can be read with the aid of a scale provided on the wall of the container. After screwing of the combination part 4 onto the supply container and insertion of the brush member 8, a mixing position shown in FIG. 1*a* is attained, in which the throughgoing opening 13 is closed by a projection 10*a*. The wall 2 is squeezed and shaken, whereby the components of the hair dye are mixed with one another. After this, the brush member 8 is again displaced to the application position shown in FIG. 1 and the hair dye process can start. The user takes the apparatus in his hand in the position shown in FIG. 1, separates one hair bundle with the aid of the separating tip 5, combs it by the comb member 6 and applies a hair dye by the brush member 8 onto the hair to be dyed by a slight pressure upon the wall 2 of the supply container. The hair dye is thereby brought through the slot-shaped elastic nozzle member 15 closely to the free ends of the bristle bundles 9, so that particularly hair roots can be dyed in effective manner. Since the nozzle insert 15 has an elastic wall, it always moves together with the movement of the bristle bundles 9 of the brush member 8.

When the dyeing process is finished, the residual portion of the hair dye which remains in the apparatus can be easily cleaned with warm water when the brush member 8 is removed and the combination part 4 is unscrewed from the supply container 1. After this, the above-described hair-dyeing process can be repeated again as often as necessary.

For more reliably attaining equalization of pressure through the slot-shaped nozzle insert 15 during reduction of pressure against the wall 2 of the supply container 1, three longitudinal partitions 15*a* are provided in the interior of the nozzle insert and connected with one of its two longitudinal walls. Air required for pressure equalization can flow between the longitudinal partitions 15*a* into the interior of the supply container 1 wherein a negative pressure is formed. No gluing and thereby closing of these air supply openings takes place.

When the wall 2 of the supply container 1 is constituted of rigid material, for example extrusion molded synthetic plastic material, in which case it cannot be completely emptied from hair dye, a respective residual amount of hair dye must be removed by spraying, which is of course disadvantageous.

In order to eliminate this disadvantage, it is advisable to design a hair dye applicating apparatus in accordance with a second embodiment of the invention which will be described hereinbelow. FIGS. 2–5 show the hair dye applicating apparatus in accordance with the second embodiment of the invention.

The combination part 4 has a geometrical dimensions substantially corresponding to the dimension of the combination part shown in FIG. 1. The separating tip 5 has a longitudinal axis including an angle $\alpha$ of approximately 11° with the longitudinal axis of the supply container 1. The longitudinal axes of the tines 7 of the comb member include an angle $\gamma$ of approximately 82.5° with the longitudinal axis of the supply container 1. The longitudinal axes of the bristle bundles 9 of the brush member include an angle $\beta$ of approximately 70° with the longitudinal axis of the container 1. The supply container 1 has a cylindrical transparent wall 2 which, however, is rigid. A piston 16 axially reciprocates in the interior of the wall 2. A piston rod 17 is connected with the piston 16 for joint axial displacement but rotatable relative to the latter. The piston rod 17 extends outwardly beyond the supply container 1 as can be seen from FIGS. 4 and 5.

The piston rod 17 is provided at its diametrically opposite longitudinal sides with toothed racks 19 and 20 which are fixedly connected with the piston rod. The toothed racks 19 and 20 have sawtooth-shaped teeth 21. A catch-shaped engaging member 23 of a transporting device 22 engages in the teeth 21 of the piston rod 17. It is elastically resilient and fixedly connected with a ring 24. The ring 24 is urged by a pressure spring 25 in direction toward a free end 29 of the piston rod 17. The spring 29 abuts against an inner wall 26 of a closure element 27.

An actuating member 31 is located between the ring 24 and an outer wall 30 of the closure element 27, and surrounds a piston rod 17. The actuating member 31 is arranged pivotally about a pivot axis 32. A free end 33 of the actuating member 31 is articulately connected with an actuating rod 28 which is supported on the outer wall of the supply container 1 in a cover 34 and displaces in the longitudinal direction. The actuating rod 28 has an end facing toward the combination part 4 and provided with an actuating projection 35 at this end, as can be seen from FIG. 4.

When the actuating projection 35 is displaced in direction toward the combination part 4, the ring 24 and thereby the catch-shaped engaging member 23 move in the same direction. Because of the sawtooth-shaped teeth 21, the piston rod is also displaced in the same direction in a known manner. When the actuating projection 35 is released, the pressure spring 25 presses the ring 24 in its initial position, whereby the catch-shaped engaging member 23 disengages from the teeth 21 and again engages behind the respective neighboring or next tooth 21. During each actuating stroke of the actuating projection 35, a respective forward displacement of the piston 16 in direction toward the combination part 4 is performed. Thereby the hair dye accommodated in the interior of the supply container 1 is supplied via the inner space 14 to the outlet opening 15*b* of the brush member 8.

The closure element 27 is removably connected with the container 1, and more particularly with its end portion which is spaced from the combination part 4. The closure element 27 is secured against unintentional unscrewing with the aid of an axially displaceable locking push member 27*a*, as can be seen from FIG. 5.

A ball 37 which is fixedly connected with the piston 16 is located in the interior of the supply container 1 in the region between the piston 16 and the combination part 4. The connection of the ball 37 with the piston 16 is performed with the aid of a filament 36. The ball 37 facilitates the intermixing of the hair dyes, as can be seen from FIG. 2. The connection of the ball 37 with the piston 16 by the filament 36 guarantees that during a required dismounting, for example for cleaning, the ball will not be lost. The combination part 4 is selectively removable from the container 1 and has a pin 39 located in the interior of the combination part 4 and extending in an axial direction toward the supply container 1. The length of the pin 31 is so selected that when the combination part 4 is fitted onto the supply container, a throughgoing passage 40 remains between the ball 37 and the wall of the application part 4. This throughgoing passage is required for unobjectionable supply of hair dyes.

Figure 5:
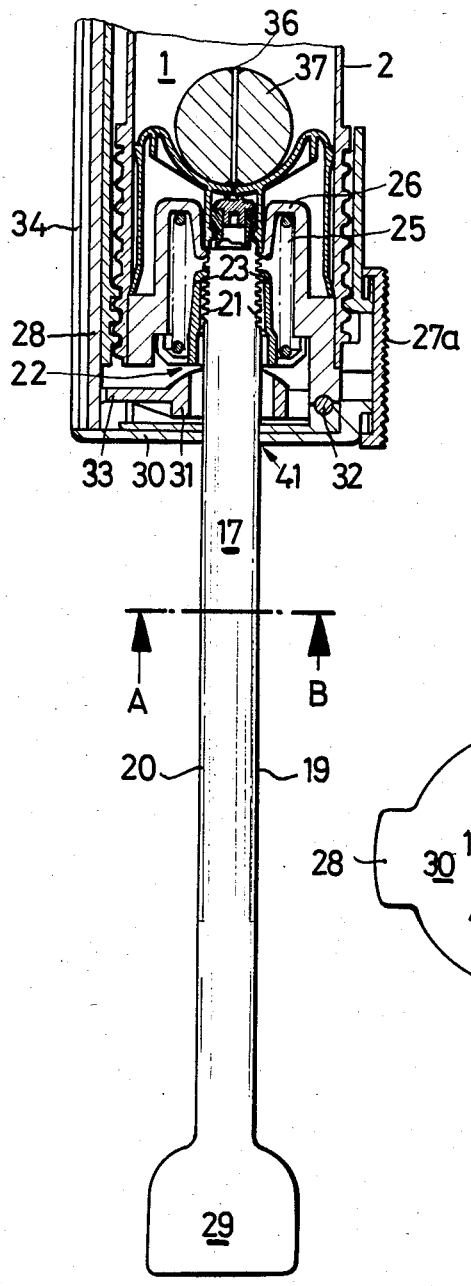
FIG. 5 is a view showing a longitudinal section of the supply container of the apparatus of FIG. 1 in the region adjacent to an application part of the apparatus, in filled condition and in position similar to FIG. 4.
Figure 6:
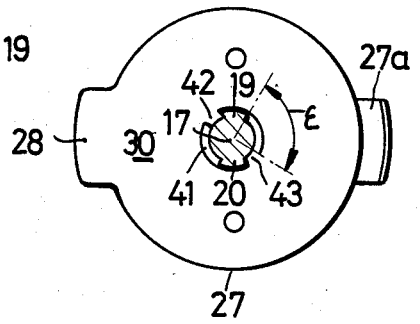
FIG. 6 is a view showing a section taken along the line A-B in FIG. 5.

As can be bettter recognized from FIGS. 5 and 6, an end of the supply container 1 which is spaced from the combination part 4 is firmly closed by the closure element 27 having the inner wall 26 and the outer wall 30 and provided with an axial opening 41 for the piston rod 17. The axial opening 41 in the outer wall 30 has two projections 42 and 43 which extend diametrically inwardly of the opening 41. The projections 42 and 43 cooperate with the lateral flanks of the toothed racks 19 and 20 of the piston rod 17 in such a manner that by rotation of the piston rod 17 (in which case the piston 16 must not rotate together with the piston rod 17) by 90° in respective directions, one lateral tooth flank abuts against the associated sides of both projections 42 and 43 whereby a transporting position is assumed, or another lateral tooth flank abuts against the opposite side of both projections 42 and 43 whereby a filling position is attained. In the filling position, the piston rod 17 freely moves in an axial direction together with the piston 16 fixedly connected therewith.

An intermediate member 46 has a thread 4*a* for connecting with the supply container 2, and thread 45 for connecting with the combination part 4. The intermediate member 46 has a threaded tubular portion 47 which faces toward the combination part 4 and has an inner diameter which is smaller than the inner diameter of the opening 3 of the supply container 1. The pin 39 which cooperates with the ball 37 is located inside the portion 47 and fixedly connected with the remaining portion of the application part 4, as can be seen from FIG. 2. For filling of the emptied supply container 1, it can be put directly with the portion 47 of its intermediate member 46 against a pack with the components to be supplied. Then, under the action of negative pressure, for example formed by a pump, in condition of the retracting piston 16, the supply container may be filled to such an extent until the end position shown in FIG. 5 is attained. When the supply container is retained so that the intermediate member 46 extends downwardly, the ball 37 abuts, because of its weight against the inner wall of the intermediate member 46 and opens only in condition of negative pressure.

Figure 7:
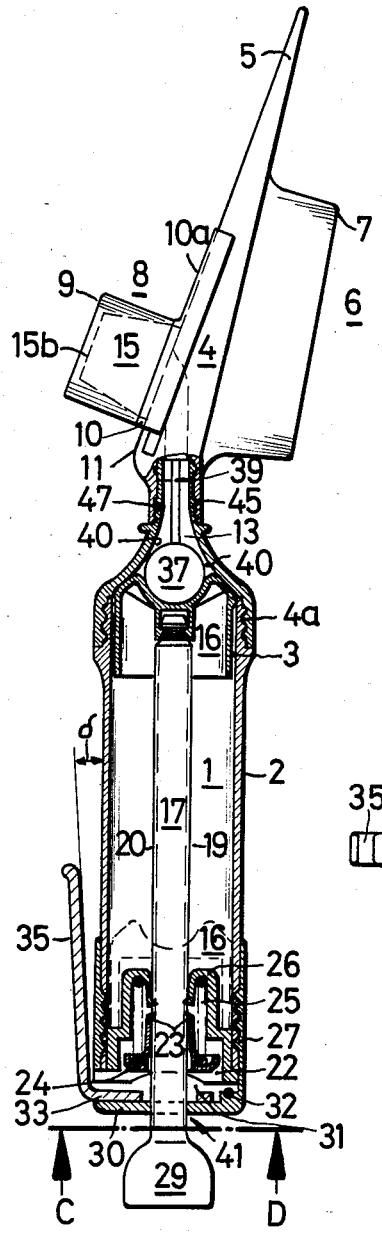
FIG. 7 is a view showing a hair dye applicating apparatus in accordance with a third embodiment of the present invention, in emptied condition.
Figure 8:
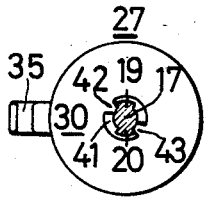
FIG. 8 is a view showing a section taken along the line C-D in FIG. 6.

The hair dye applicating apparatus shown in FIGS. 7 and 8 has a somewhat different transporting device 22 in which the actuating member 31 has an outwardly extending actuating portion 35'. The actuating portion 35' in its inoperative position includes an angle $\beta$ of at least 2°, preferably of 4°, with the outer wall 2 of the supply container 1. The transporting device 22 is so designed that when in the transporting position the actuating projection 35 is pressed toward the outer wall 2 of the supply container 1, the piston rod 17 and the piston 16 connected therewith displace in direction toward the application part 4. The actuation is performed in this case substantially by the fourth finger and the little finger of the user.

Figure 9:
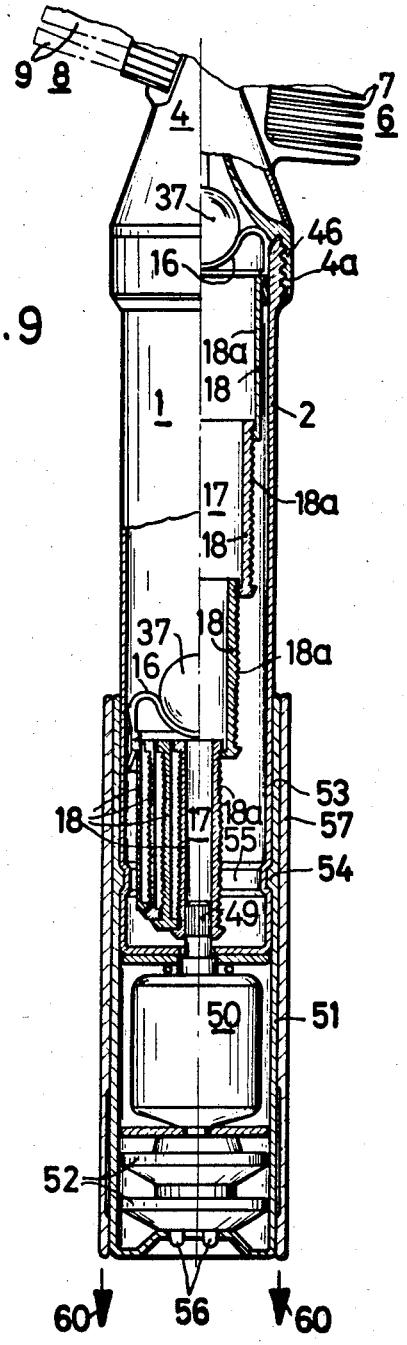
FIG. 9 is a view showing a hair dye applicating apparatus in accordance with a further embodiment of the present invention, in assembled condition wherein the left half is shown in filled position and the right half is shown in emptied position.
Figure 10:
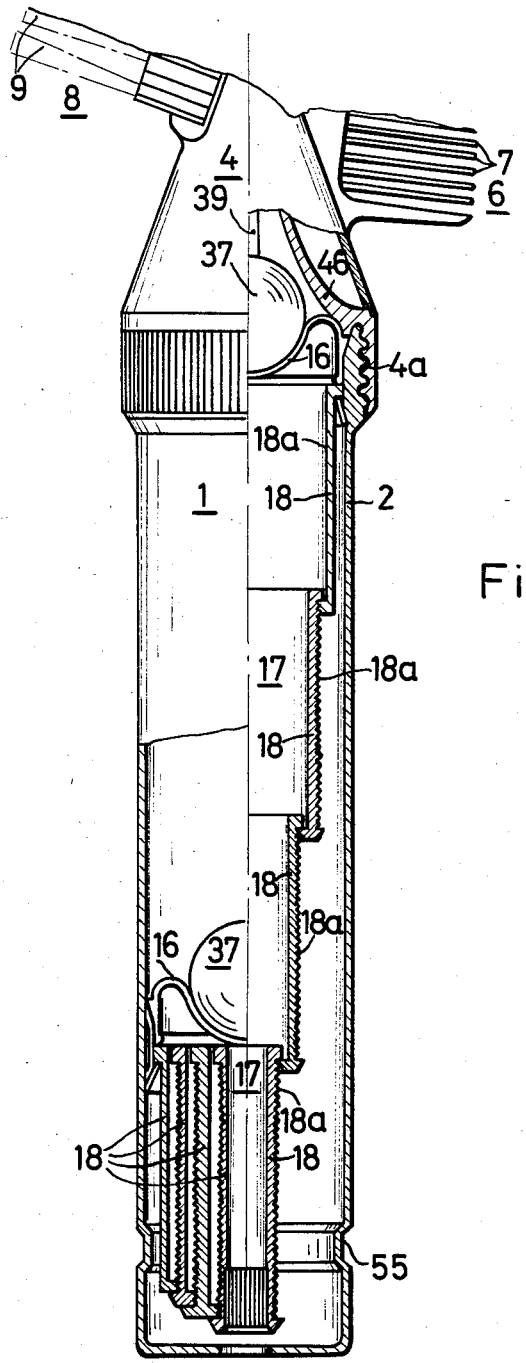
FIG. 10 is a view showing a part of a structure which carries a coupling means, of the apparatus shown in FIG. 9.
Figure 11:
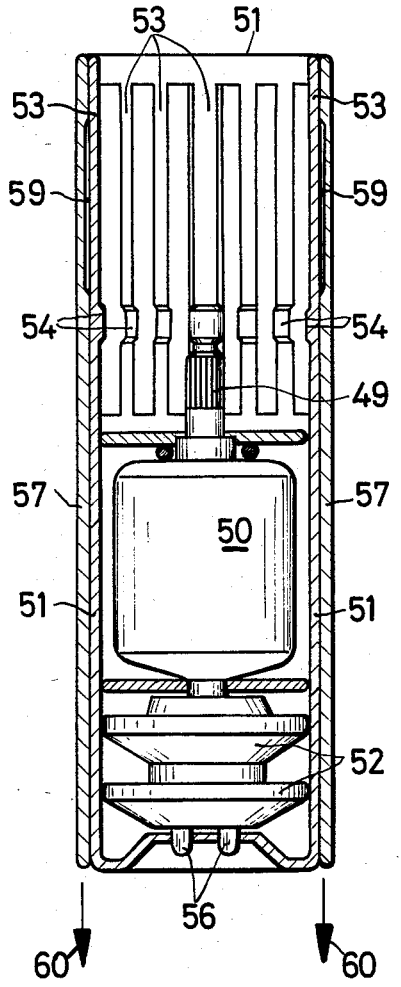
FIG. 11 is a view showing another part of the structure which carries the coupling means, of the apparatus shown in FIG. 9.

A hair dye applicating apparatus in accordance with a further embodiment is shown in FIGS. 9–11. The piston rod 17 of this apparatus is telescopic and includes a plurality of individual telescopically displaceable tubulart portions 18. The portions 18 have outer and inner threads 18' and engage one another with the aid of these threads. The piston 16 is mounted in the cylindrical wall 2 so that it cannot rotate. The piston rod 17 has a portion 18 which is spaced from the piston 16 and is fixedly connected with a driving shaft 49 of a direct current electric motor 50 for joint rotation with this shaft. Rechargeable batteries 52 are used for supply of the electric motor 50. The electric motor 50 and the rechargeable batteries 52 are accommodated in a housing part 51 which is preferably cylindrical. For cleaning purposes, the cylindrical housing part 51 is removably connected with the supply container 1 by coupling means.

The inner wall of the housing part 51 (FIG. 11) has at its side facing toward the supply container 1, axially extending rib-shaped coupling catches 53. The latter have radially inwardly extending nub-shaped projections 54 which cooperate with an annular groove 55 formed in the supply container 1 so as to form together a coupling means.

A locking sleeve 57 is arranged at a cylindrical outer surface of the housing part 51 and is axially displaceable and concentric with the latter. The locking sleeve 57 is shown in FIG. 11 in locked position. The locking sleeve 57 is provided at its inner side in the central region of the rib-shaped coupling catches 53 with a wide ring-shaped recess 59. During the axial displacement of the locking sleeve 57 against the force of a not shown spring in direction of the arrow 60, the recess 59 comes to a position in which it is located behind the knub-shaped projections 54. Thereby during fitting onto the counter member formed on the supply container 1, the projections 54 can spring radially outwardly and engage in the annular groove 59. A not shown spring provides for return of the locking sleeve 57 to the shown locking position.

Figure 4:
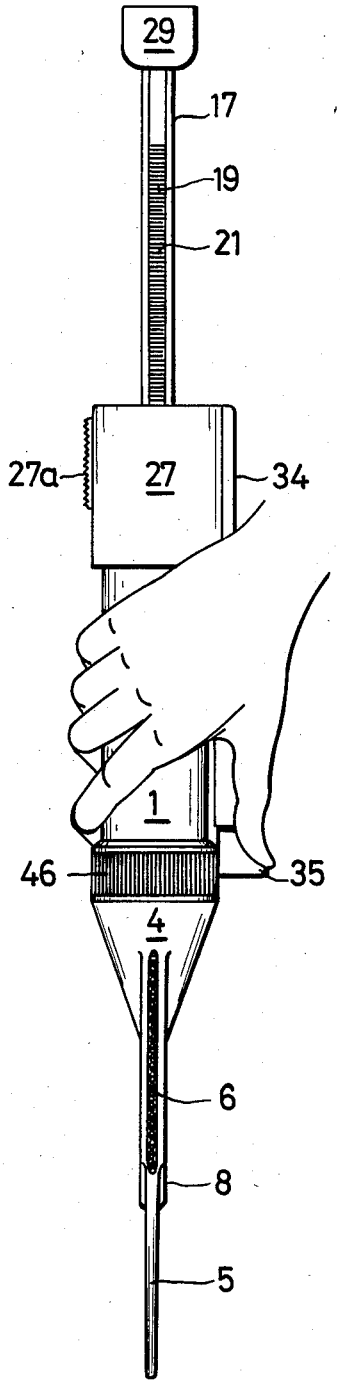
FIG. 4 is a view of the apparatus of FIG. 2 which is turned by 90° relative to the view of FIG. 3, wherein tines of a comb member of the apparatus are located at the side facing toward a viewer and can be seen during the operation.

The batteries 52 are provided with a charging device formed as a support and can be charged via both contact springs 56 from a current network during a time of non-use. A not shown actuating projection similar to the actuating projection 35 in FIG. 4, is provided on the supply container 1. An electric switch for switching on and switching off of the electric motor 5 can be actuated by such an actuating projection.

It will be understood that each of the elements described above, or two or more together, may also find a useful application in other types of constructions differing from the types described above.

While the invention has been illustrated and described as embodied in a hair dye applicating apparatus, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the present invention.

What is claimed as new and desired to be protected by Letters Patent is set forth in the appended claims:

1. A hair dye applicating apparatus, comprising a handle part formed as a hair dye supply container having a longitudinal axis; a combination part connected with said supply container and having a hair separating tip arranged in spaced relationship with said supply container and extending at an acute angle to said longitudinal axis, a comb member with a plurality of tines and arranged adjacent to said supply container, and a hair dye application part including a brush member with a plurality of bristle bundles extending at an acute angle to said longitudinal axis and an elastic hollow slot-shaped nozzle member located inside said brush member so as to be surrounded by said bristle bundles at its both longitudinal sides and to form an outlet opening to supply a hair dye to tips of the bristle bundles; and means forming a throughgoing opening between said supply container and said brush member of said combination part, said application part of said combination part being displaceable between one position in which said throughgoing opening is closed and another position in which it is open.

2. A hair dye applicating apparatus as defined in claim 1, wherein said combination part is removably mounted on said handle part formed as the supply container; and further comprising means for removably mounting said combination part on said supply container.

3. A hair dye applicating apparatus as defined in claim 1, wherein said nozzle member is slot-shaped.

4. A hair dye applicating apparatus as defined in claim 1, wherein said nozzle member is constituted of rubber.

5. A hair dye applicating apparatus as defined in claim 1, wherein said elastic nozzle member has a transverse dimension, said bristle bundles of said brush member overlapping said transverse dimension of said elastic nozzle member.

6. A hair dye applicating apparatus as defined in claim 1, wherein said elastic nozzle member has two longitudinal walls having inner sides facing toward one another, one of said longitudinal walls of said elastic nozzle member having at least one partition provided on the inner side thereof.

7. A hair dye applicating apparatus as defined in claim 1, wherein said supply container, the bristle bundles of said brush member and the tines of said comb member have longitudinal axes, the longitudinal axis of said container including an angle of at least 40° with the longitudinal axes of said bristle bundles of said brush member, and an angle of at least 60° with the longitudinal axes of said tines of said comb member.

8. A hair dye applicating apparatus as defined in claim 1, wherein said supply container has a creasable elastic wall.

9. A hair dye applicating apparatus as defined in claim 2; and further comprising means for displaceably mounting said brush member on said combination part, and including a dovetailed groove formed in said brush member on its side facing toward said application part, and a dovetailed projection formed on said combination part and engaging in said dovetailed groove.

10. A hair dye applicating apparatus as defined in claim 9, wherein said dovetailed projection of said combination part has a predetermined length and is provided with a slot-shaped throughgoing opening which communicates with the interior of said supply container and has a length equal to at most 40% of the length of said dovetailed projection of said combination part.

11. A hair dye applicating apparatus as defined in claim 9, wherein said dovetailed projection of said combination part has a slot-shaped throughgoing opening having a predetermined length, said brush member having a protrusion which forms an extension of said dovetailed groove and is provided with a further throughgoing opening arranged to receive said elastic nozzle member, said further throughgoing opening having a length exceeding the length of said throughgoing opening of said dovetailed projection.

12. A hair dye applicating apparatus as defined in claim 10, wherein said throughgoing opening of said dovetailed projection of said combination part has a length which is equal to 30% of the length of said dovetailed projection.

13. A hair dye applicating apparatus as defined in claim 7, wherein the angle between said longitudinal axis of said container and said longitudinal axes of said bristle bundles of said brush member is equal to 50°.

14. A hair dye applicating apparatus as defined in claim 7, wherein the angle between said longitudinal axis of said container and said longitudinal axes of said tines of said comb member is equal to 75°.

15. A hair dye applicating apparatus as defined in claim 8, wherein said creasable elastic wall of said container is constituted of a synthetic plastic material.

* * * * *